US007496979B2

(12) United States Patent
Hempker

(10) Patent No.: US 7,496,979 B2
(45) Date of Patent: Mar. 3, 2009

(54) PATIENT TABLE WITH FOOTREST EXTENSION

(75) Inventor: James Christopher Hempker, Troy, OH (US)

(73) Assignee: Midmark Corporation, Versailles, OH (US)

( * ) Notice: Subject to any disclaimer, the term of this patent is extended or adjusted under 35 U.S.C. 154(b) by 7 days.

(21) Appl. No.: 11/769,183

(22) Filed: Jun. 27, 2007

(65) Prior Publication Data

US 2009/0000033 A1 Jan. 1, 2009

(51) Int. Cl.
*A61G 7/015* (2006.01)
*A61G 7/075* (2006.01)

(52) U.S. Cl. ..... 5/618; 5/613; 5/624; 297/423.28; 297/423.35

(58) Field of Classification Search ..... 5/618, 5/613, 600, 624, 621, 648, 503.1, 507.1, 5/658, 661; 297/124, 119, 120, 423.28, 423.35
See application file for complete search history.

(56) References Cited

U.S. PATENT DOCUMENTS

| | | | | | |
|---|---|---|---|---|---|
| 132,503 | A | * | 10/1872 | Travis | 297/423.22 |
| 136,734 | A | * | 3/1873 | Johnson | 297/423.28 |
| 158,637 | A | * | 1/1875 | Head | 297/423.28 |
| 276,687 | A | * | 5/1883 | Hartley | 297/61 |
| 282,095 | A | * | 7/1883 | Luburg | 297/423.32 |
| 327,775 | A | * | 10/1885 | Dodge | 297/320 |
| 375,448 | A | * | 12/1887 | Hayward | 297/423.28 |
| 482,745 | A | * | 9/1892 | Lewis | 297/130 |
| 483,900 | A | * | 10/1892 | Case | 297/342 |
| 485,435 | A | * | 11/1892 | Stern | 4/480 |
| 490,540 | A | * | 1/1893 | Case | 5/624 |
| 740,966 | A | * | 10/1903 | Wylie | 297/317 |
| 1,301,877 | A | * | 4/1919 | Riemenschneider | 297/28 |
| 2,120,732 | A | * | 6/1938 | Comper et al. | 5/602 |
| 2,257,491 | A | * | 9/1941 | Armstrong | 5/602 |
| 2,306,031 | A | | 12/1942 | Anderson et al. | |
| 2,714,541 | A | * | 8/1955 | Reichert et al. | 5/624 |
| 2,804,363 | A | * | 8/1957 | Spielberg | 5/624 |
| 2,832,655 | A | * | 4/1958 | Adolphson | 5/602 |
| 3,100,129 | A | * | 8/1963 | Adolphson | 297/423.22 |
| 3,609,779 | A | | 10/1971 | Oja et al. | |
| 4,021,028 | A | | 5/1977 | Weber et al. | |
| 4,034,972 | A | * | 7/1977 | Peterson | 5/618 |
| 4,678,229 | A | * | 7/1987 | Ryan et al. | 297/68 |
| 5,454,126 | A | * | 10/1995 | Foster et al. | 5/618 |
| 6,226,821 | B1 | * | 5/2001 | Heimbrock et al. | 5/690 |
| 6,282,738 | B1 | * | 9/2001 | Heimbrock et al. | 5/618 |
| 6,412,126 | B2 | * | 7/2002 | Heimbrock et al. | 5/618 |
| 6,446,287 | B2 | | 9/2002 | Borders | |
| 6,618,882 | B2 | * | 9/2003 | Heimbrock et al. | 5/618 |
| 6,983,501 | B2 | * | 1/2006 | Heimbrock et al. | 5/602 |
| 2001/0011394 | A1 | * | 8/2001 | Heimbrock et al. | 5/618 |
| 2002/0092096 | A1 | * | 7/2002 | Heimbrock et al. | 5/618 |
| 2004/0226094 | A1 | * | 11/2004 | Heimbrock et al. | 5/618 |

* cited by examiner

*Primary Examiner*—Robert G Santos
(74) *Attorney, Agent, or Firm*—Wood, Herron & Evans, LLP

(57) ABSTRACT

A vertically moveable patient table is provided with a footrest extension that may be locked in either an operative, extended position or a stowed position beneath an adjacent leg section of the table. In the stowed position the footrest extension actuates a switch which permits the table to be moved freely up and down. However, when the footrest extension is in any position other than stowed, movement of the table is restricted to prevent accidental contact of the footrest extension with a floor or other supporting surface as the table is lowered.

5 Claims, 6 Drawing Sheets

PATIENT TABLE WITH FOOTREST EXTENSION

BACKGROUND OF THE INVENTION

To facilitate positioning a patient on a table, it is desirable that the table be capable of being lowered to a position for easy access by the patient. This is particularly true where the patient may be infirm and, indeed, is being transferred from a wheelchair onto the table. Once the patient is positioned on the table, it may be raised to a height that is convenient for the physician attending the patient. It is also desirable that the table have the capability of supporting different size patients and, in this regard, a footrest extension may be attached in some manner to the table to provide support of the lower extremities of the patient when the table is in the raised position. It is also desirable that the footrest extension not interfere with lowering the table to, for example, a wheelchair accessible position.

SUMMARY OF THE INVENTION

A patient table in accordance with the present invention is mounted on a base for movement vertically between minimum and maximum distances above a floor or other supporting surface. The table is provided with a footrest extension that is pivotally mounted along one lateral edge to an adjoining lateral edge of a leg section of the table, with the footrest extension being moveable between a patient-supporting position substantially coplanar with the adjacent leg section and a stowed position in which the footrest extension is pivoted through 180 degrees up under the leg section with opposing lower surfaces of the footrest and leg section in proximate relationship.

A lock is provided for securing the footrest alternatively in said operable and stowed positions. The lock includes a spring-loaded plunger engageable in sockets formed in the linkage interconnecting the footrest and leg section. A lock release is mounted on the undersurface of the footrest and is operable from either side edge of the footrest. To prevent inadvertent operation of the lock release, bumpers are positioned adjacent the side edges of the footrest to shield the lock releases from inadvertent actuation.

A switch is mounted on the undersurface of the leg section and is engaged by the corresponding undersurface of the footrest when the footrest is moved from the operable, substantially coplanar position to the stowed parallel position. The switch is connected to appropriate mechanism for preventing inadvertent contact of the table with the floor or other supporting surface as the table is lowered.

DESCRIPTION OF THE PREFERRED EMBODIMENT

Figure 1:
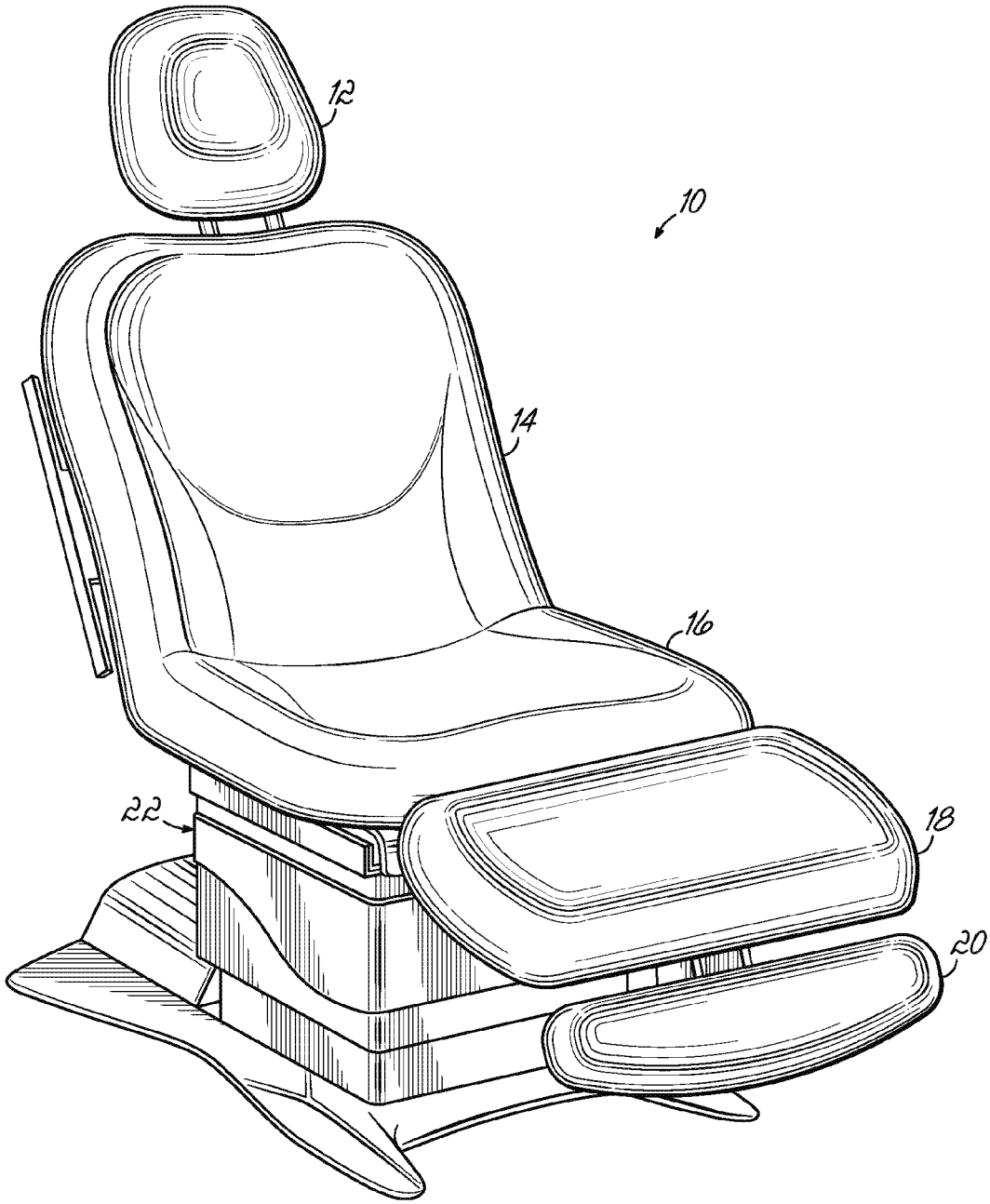
FIG. 1 is a perspective view of a patient table in accordance with the present invention.

As seen in FIG. 1 of the drawings, a table 10, in accordance with the present invention, may include a plurality of patient-supporting sections interconnected to define a patient-supporting surface. Specifically, the table may include a headrest 12, a back section 14, a seat section 16, a leg section 18, and a footrest 20. The entire table is mounted on a base 22 which may be provided with a conventional mechanism for raising and lowering the table between minimum and maximum distances above a floor or other supporting surface. The specific raising and lowering mechanism is not shown, but may be of any existing designs, particularly those currently utilized in tables manufactured by the assignee of the present invention. It will be appreciated that the headrest 12, the sections 14, 16 and 18 and the footrest 20 may be moved from their positions shown in FIG. 1 to a substantially coplanar, patient-supporting configuration, as is conventional in the art.

Figure 2:
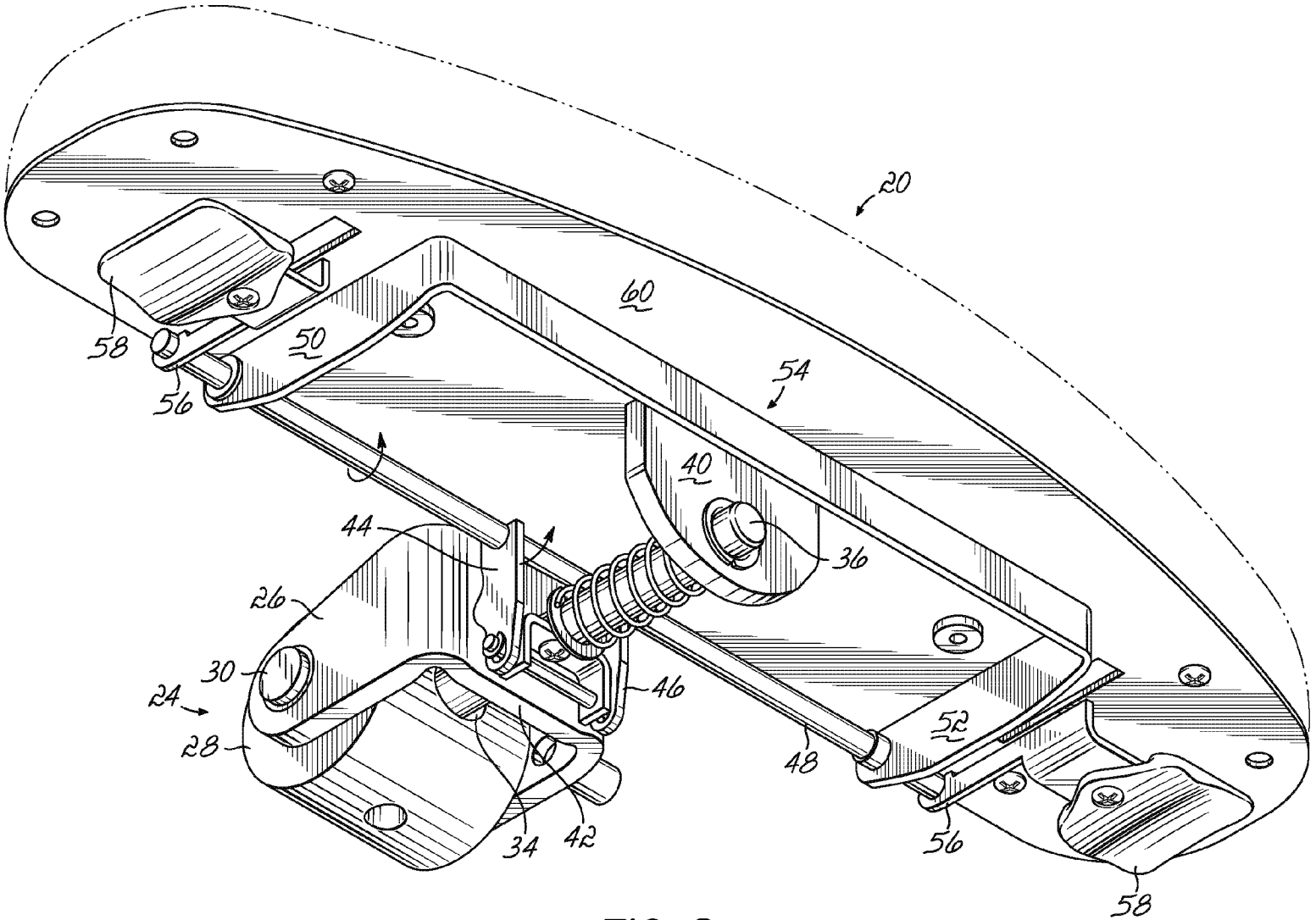
FIG. 2 is a perspective view of the undersurface of the footrest with a spring-loaded plunger seated in a socket.
Figure 3:
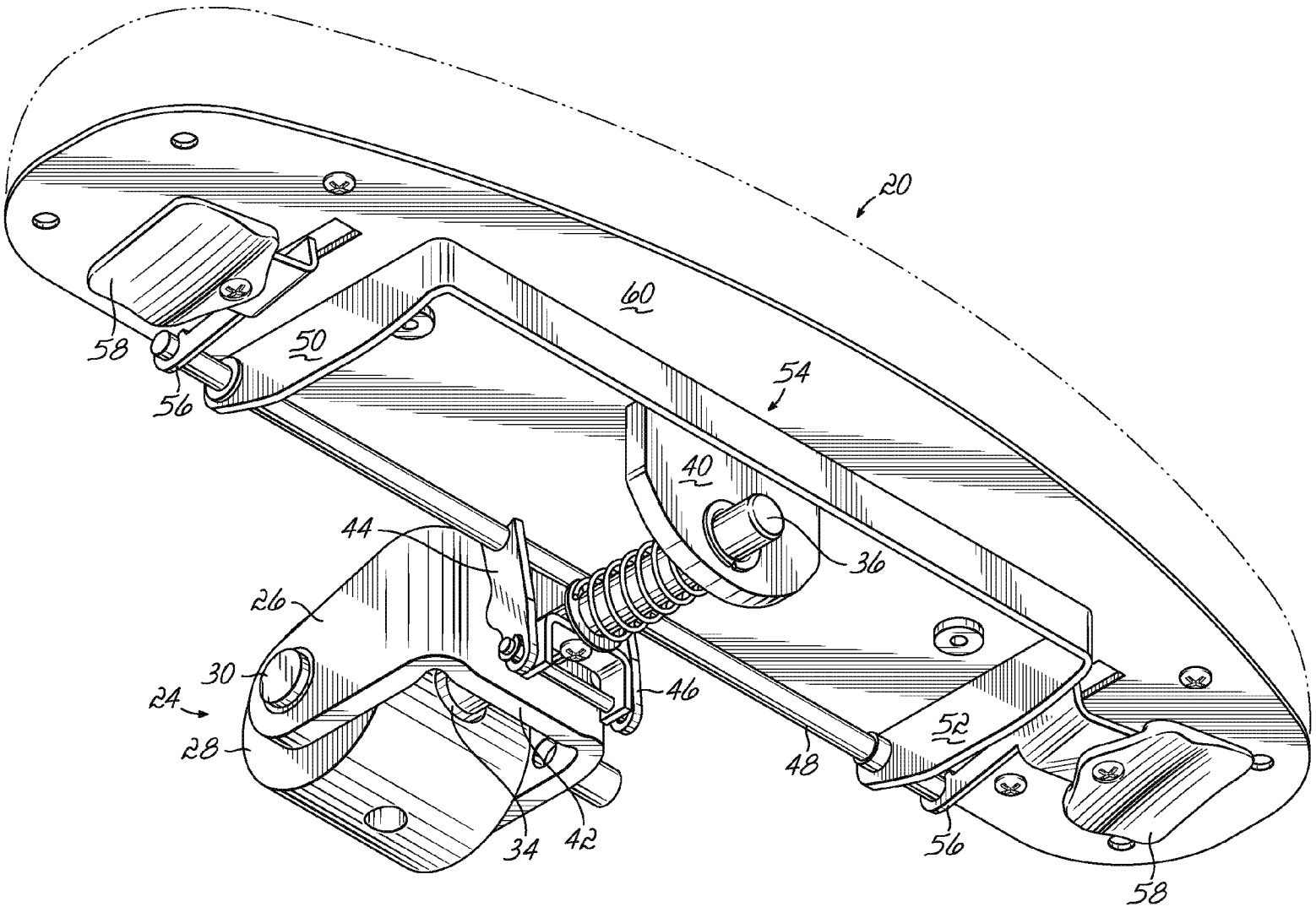
FIG. 3 is a view similar to FIG. 2, but with the spring-loaded plunger retracted from the socket.
Figure 4:
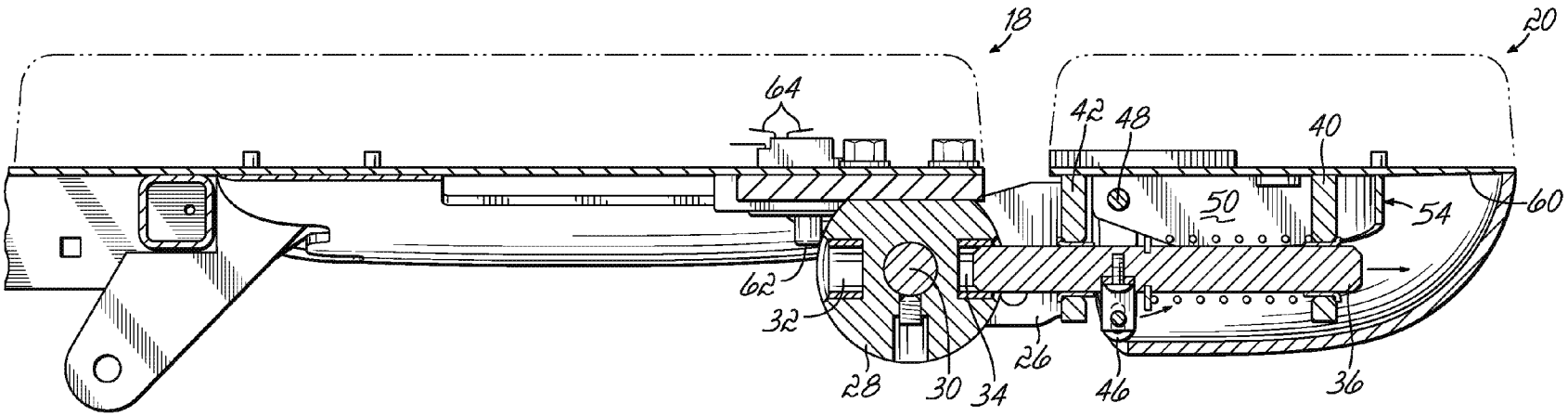
FIG. 4 is a side view, partly in section, and showing the footrest in the operable position.
Figure 5:
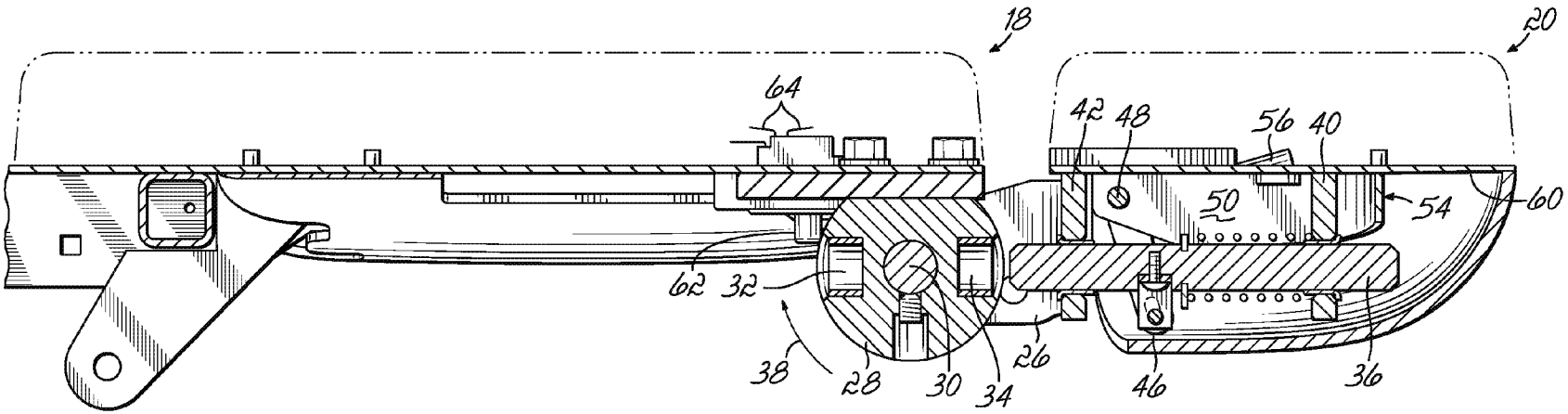
FIG. 5 is a view similar to FIG. 4, but showing the spring-loaded plunger retracted from a socket preparatory to rotating the footrest 180 degrees into the stowed position.
Figure 6:
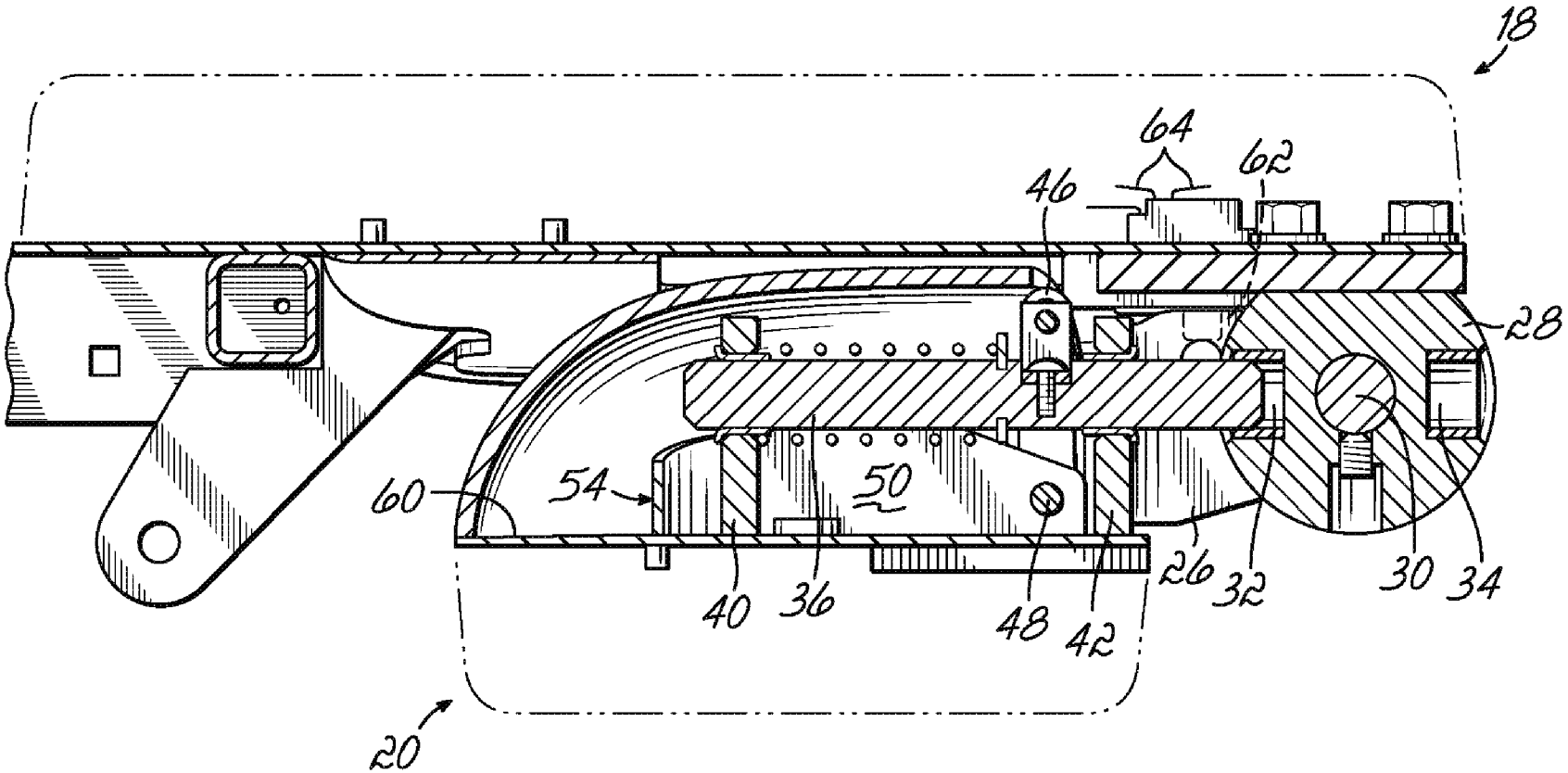
FIG. 6 shows the footrest in the stowed position with the spring-loaded plunger engaging a stowed position socket.
Figure 7:
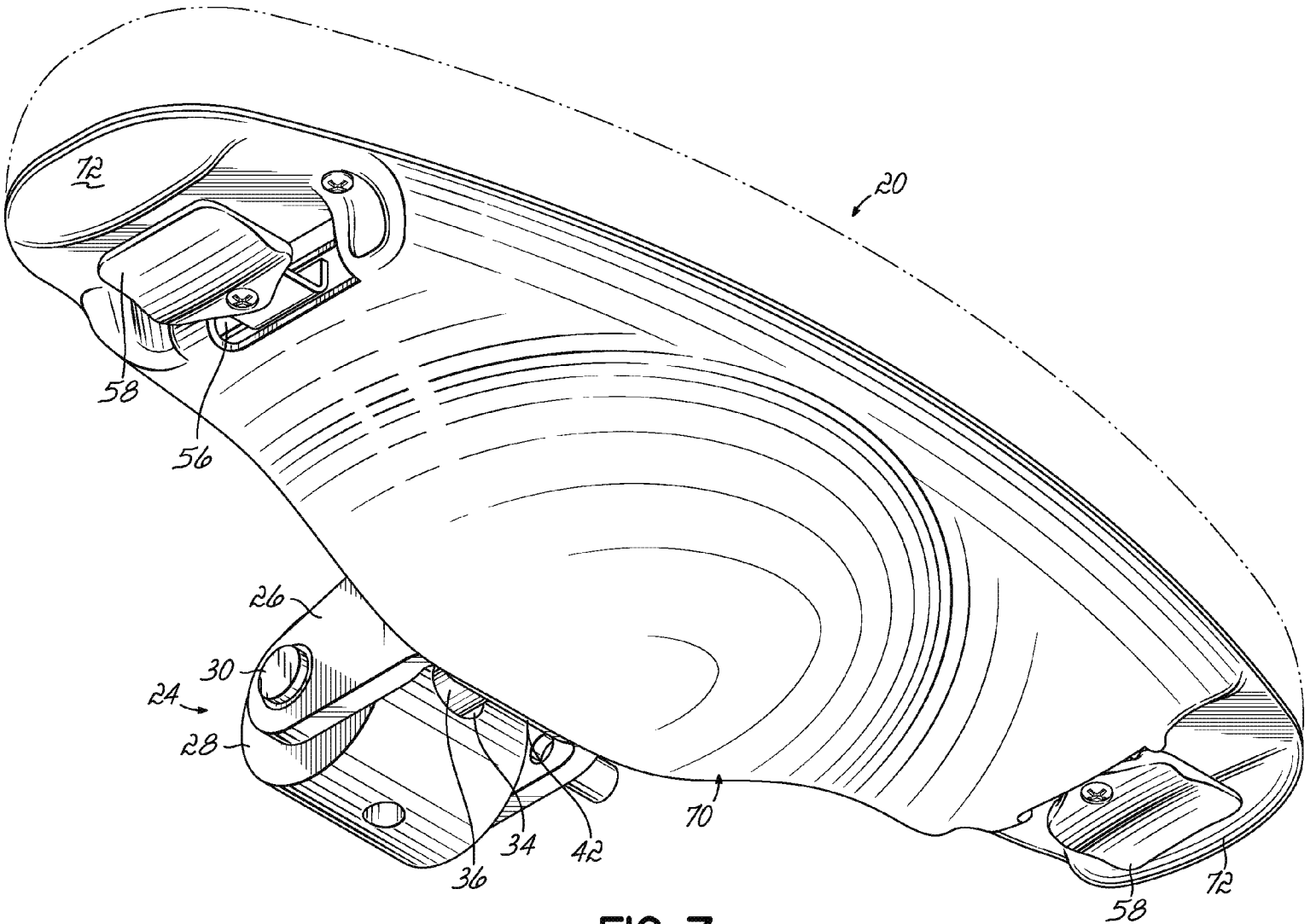
FIG. 7 is a view similar to FIGS. 2 and 3, but with a cover in place which includes bumpers for preventing inadvertent actuation of the spring-loaded plunger.

As seen in FIGS. 2, 3, 4, 5 and 6, the footrest 20 is connected to the leg section 18 by a linkage 24 that, as particularly seen in FIGS. 2 and 3, may comprise a clevis 26 straddling a block 28, which carries a pintle 30. The clevis 26 is rigidly attached to the footrest 20, while the block 28 is fixed to the leg section 18, as best seen in FIGS. 4, 5 and 6 of the drawings.

It will also be noted that the block 28 has a pair of opposed sockets 32 and 34 adapted to receive a spring-loaded plunger 36 mounted for a reciprocating movement on the undersurface of the footrest 20. In FIG. 4 the plunger 36 is shown engaged in a socket 34, locking the footrest in an operable position substantially coplanar with the leg section 18. In FIG. 5, it will be seen that the plunger 36 has been retracted from a socket 34 preparatory to the footrest 20 being pivoted around the pintle 30 in the direction indicated by the arrow 38 in FIG. 5 of the drawings. In FIG. 6, the footrest 20 is shown rotated through approximately 180 degrees about the pintle 30 and into a stowed position substantially parallel with the footrest 18. In this position, the plunger 36 is now seated in the socket 32.

The position of the footrest 20 in FIG. 4 corresponds to that shown in FIG. 2 and it will be seen from FIG. 2 that the plunger 36 is slidedly mounted in a block 40 at one end and through a cross member 42 of the clevis 26 at its opposite end. A pair of rocker arms 44 and 46 are, as best seen in FIGS. 2 and 3 of the drawings, fixed to a rotatable shaft 48, which in turn, is rotatably mounted at opposite ends in the legs 50 and 52 of the U-shaped section 54. Fixed to opposite ends of the shaft 48 are a pair of actuating arms 56, each of which carries a finger-engageable tab 58. It will be apparent from an inspection of FIGS. 2 and 3 that pushing tabs 58 up towards the lower surface 60 of the footrest causes the rod 48 to rotate, and through the arms 44 and 46, retract the plunger 36 from the position shown in FIG. 2 of the drawings where the plunger is engaged in the socket 34 to the disengaged position shown in FIG. 3.

It will be particularly noted from FIGS. 4 and 5 of the drawings that a switch 62 is mounted on a lower surface of the leg section 18 and, upon rotation of the footrest 20 from the position shown in FIGS. 4 and 5 of the drawings to that shown in FIG. 6 of the drawings, the switch 62 is engaged and actuated by the lower surface of the footrest 20. The switch 62 is operatively connected by the leads shown at 64 to a mechanism for effecting raising and lowering of the table with respect to the floor or other supporting surface.

Thus, when the footrest is rotated to the stowed position of FIG. 6 of the drawings, the switch 62 is engaged, allowing full movement of the patient table. However, with the footrest in non-switch engaging positions, table movement is restricted to prevent inadvertent collision of the table with the floor or other supporting surface.

From the above it will be seen that the footrest release mechanism is operable from either side of the footrest by simply depressing one or both of the tabs 58. However, it is desirable to prevent inadvertent actuation of the release mechanism as might occur if someone or something should accidentally come into contact with one of the tabs 58. In this regard, the footrest 20 is provided with a cover 70, which may be of molded construction and include bumpers, as at 72, to shield the actuating tabs 58 from inadvertent contact.

It will thus be seen that the present invention provides a patient table moveable between minimum and maximum positions with respect to a floor or other supporting surface and having a footrest that may be extended as needed, while at the same time, avoiding inadvertent contact of the table with the floor or supporting surface as the table is lowered.

While the present invention has been illustrated by the description of one or more exemplary embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A patient table comprising:

a plurality of interconnected patient-supporting sections, including a leg section and a footrest, each having lateral and side edges and upper and lower surfaces;

a base supporting said patient-supporting sections and including a mechanism for raising and lowering said patient-supporting surface with respect to a supporting surface;

linkage interconnecting said leg section and said footrest;

said linkage permitting movement of said footrest between an operable position substantially coplanar with said leg section and a stowed position beneath said leg section with said lower surfaces of said footrest and said leg section in facing juxtaposed relationship; and a switch operable to restrict movement of said patient-supporting surface relative to said supporting surface in response to positioning of said footrest with respect to said leg section.

2. The table of claim 1 wherein:

said switch is operable in response to movement of said footrest into said stowed position.

3. The table of claim 2 wherein:

said switch is mounted on said lower surface of said leg section for engagement by said footrest in said stowed position.

4. A patient table comprising:

a plurality of interconnected patient-supporting sections, including a leg section and a footrest, each having lateral and side edges and upper and lower surfaces;

a base supporting said patient-supporting sections and including a mechanism for raising and lowering said patient-supporting surface with respect to a supporting surface;

linkage interconnecting said leg section and said footrest;

said linkage permitting movement of said footrest between an operable position substantially coplanar with said leg section and a stowed position beneath said leg section with said lower surfaces of said footrest and said leg section in facing juxtaposed relationship;

a lock for securing said footrest in said operable and said stowed positions; and said linkage includes spaced sockets, and said lock includes a spring-loaded plunger engageable with said sockets.

5. A patient table comprising:

a plurality of patient-supporting sections, including a head section, a back section, a seat section, a leg section, and a footrest each having lateral and side edges, a base supporting said patient-supporting sections and including a drive mechanism for raising and lowering said patient-supporting sections relative to a supporting floor, linkage interconnecting said footrest to said leg section along adjacent of said lateral edges thereof for movement of said footrest between an operable position substantially coplanar with said leg section and a stowed position substantially parallel to said leg section, said footrest and said leg section having upper and lower surfaces, said lower surfaces of said footrest and said leg section being in facing proximity to each other when said footrest is in said stowed position, a switch mounted on said lower surface of said leg section and engageable by said lower surface of said footrest in said stowed position, a pair of substantially horizontally extending sockets positioned at said adjacent lateral edge of said leg section and fixed with respect thereto, a spring-loaded plunger mounted on said footrest and engageable with said sockets alternatively in said operable and said stowed positions, a release mechanism for disengaging said plunger from said sockets, said release mechanism being operable from positions adjacent said side edges of said footrest, said switch being operatively associated with said drive mechanism for restricting movement of said table when said switch is not engaged by said footrest, and bumpers positioned adjacent said side edges of said footrest for preventing inadvertent actuation of said release mechanism.

* * * * *